US011209159B2

(12) United States Patent
Haberman

(10) Patent No.: US 11,209,159 B2
(45) Date of Patent: Dec. 28, 2021

(54) STEAM GENERATOR DUAL HEAD SLUDGE LANCE

(71) Applicant: Westinghouse Electric Company LLC, Cranberry Township, PA (US)

(72) Inventor: Eric R. Haberman, White Oak, PA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 669 days.

(21) Appl. No.: 15/936,520

(22) Filed: Mar. 27, 2018

(65) Prior Publication Data

US 2018/0224118 A1 Aug. 9, 2018

Related U.S. Application Data

(60) Division of application No. 14/059,714, filed on Oct. 22, 2013, now Pat. No. 10,012,381, which is a continuation of application No. 13/517,656, filed on Jun. 14, 2012, now abandoned, which is a continuation of application No. 12/145,828, filed on Jun. 25, 2008, now Pat. No. 8,238,510.

(60) Provisional application No. 60/947,775, filed on Jul. 3, 2007.

(51) Int. Cl.

| | |
|---|---|
| ***F22B 37/48*** | (2006.01) |
| ***F28G 1/16*** | (2006.01) |
| ***F28G 15/04*** | (2006.01) |

(52) U.S. Cl.

CPC ..... *F22B 37/486* (2013.01); *F28G 1/166* (2013.01); *F28G 15/04* (2013.01)

(58) Field of Classification Search

CPC ..... F22B 37/486; F22G 1/166; F28G 15/04
USPC ..... 122/390; 376/316
See application file for complete search history.

(56) References Cited

U.S. PATENT DOCUMENTS

| | | | | |
|---|---|---|---|---|
| 4,079,701 | A * | 3/1978 | Hickman | F22B 37/483 122/382 |
| 4,273,076 | A | 6/1981 | Lahoda et al. | |
| 4,276,856 | A | 7/1981 | Dent et al. | |
| 4,572,284 | A | 2/1986 | Katscher et al. | |
| 4,676,201 | A | 6/1987 | Lahoda et al. | |
| 4,723,076 | A | 2/1988 | Bateman | |
| 4,774,975 | A | 10/1988 | Ayers et al. | |
| 4,848,278 | A * | 7/1989 | Theiss | F22B 37/483 122/383 |
| 4,899,697 | A | 2/1990 | Franklin et al. | |
| 4,921,662 | A | 5/1990 | Franklin et al. | |
| 4,971,140 | A | 11/1990 | Stoss | |
| 5,036,871 | A | 8/1991 | Ruggieri et al. | |
| 5,069,172 | A | 12/1991 | Shirey et al. | |
| 5,615,734 | A | 4/1997 | Hyp | |
| 5,813,370 | A * | 9/1998 | Owen | F22B 37/483 122/382 |
| 6,513,462 | B1 | 2/2003 | Shiraishi et al. | |

(Continued)

*Primary Examiner* — Steven B McAllister
*Assistant Examiner* — Benjamin W Johnson
(74) *Attorney, Agent, or Firm* — K&L Gates LLP

(57) ABSTRACT

A moveable sludge lance said moveable sludge lance having duel lance heads passed through handholes in the side of a nuclear steam generator and into a central tube lane having a central stay rod which cleans with high pressure fluid through the row 1 tubes in the tube lane, where the distance between the dual lance heads is wide enough to allow the dual lance heads to extend beyond the central stay rod.

12 Claims, 4 Drawing Sheets

(56) References Cited

U.S. PATENT DOCUMENTS 7,967,918 B2 6/2011 Collin et al.

* cited by examiner

STEAM GENERATOR DUAL HEAD SLUDGE LANCE

CROSS-REFERENCE TO RELATED APPLICATION

This application is a divisional application of U.S. patent application Ser. No. 14/059,714, filed Oct. 22, 2013, which application is a continuation application of U.S. patent application Ser. No. 13/517,656, filed Jun. 14, 2012 entitled STEAM GENERATOR DUAL HEAD SLUDGE LANCE, which application claims priority from U.S. patent application Ser. No. 12/145,828, filed Jun. 25, 2008, now U.S. Pat. No. 8,238,510, issued Aug. 7, 2012, entitled STEAM GENERATOR DUAL HEAD SLUDGE LANCE AND PROCESS LANCING SYSTEM, which application claims the benefit of U.S. Provisional Patent Application Ser. No. 60/947,775, filed Jul. 3, 2007, the disclosures of which are incorporated by reference.

FIELD OF THE INVENTION

This invention relates to steam generators and more particularly to methods for removing sludge deposits from the tube sheets of steam generators, particularly nuclear steam generators using a dual head sludge lance that can bypass and extend beyond the central rod of the tube sheet support.

BACKGROUND OF THE INVENTION

A typical nuclear steam generator comprises a vertically-oriented shell, a plurality of U-shaped tubes disposed in the shell so as to form a tube bundle, a tube-sheet for supporting the tubes at the ends opposite the U-like curvature, a dividing plate that cooperates with the tube sheet forming a primary fluid inlet plenum at the one end of the tube bundle and a primary fluid outlet plenum at the other end of the tube bundle. A primary fluid inlet nozzle is in fluid communication with the primary fluid inlet plenum, and a primary fluid outlet nozzle is in fluid communication with the primary fluid plenum. This configuration is described for example by U.S. Pat. Nos. 4,079,701; 4,273,076; 4,899,697 and 4,921,662 (Hickman et al.; Lahoda et al.; Franklin et al. and Franklin et al.; respectively).

Since the primary fluid contains radioactive particles and is isolated from feedwater only by the U-tube walls, which may be constructed of Inconel®, the U-tube walls form part of the primary boundary for isolating these radioactive particles. It is, therefore, important that the U-tubes be maintained defect-free so that no leaks/breaks will occur in the U-tubes.

It has been found that there are at least two causes of potential leaks in the U-tube walls. High caustic levels found in the vicinity of the cracks in tube specimens taken from operating steam generators and the similarity of these cracks to failures produced by caustic under controlled laboratory conditions, have identified high caustic levels as the possible cause of the intergranular corrosion, and thus the possible cause of the tube cracking.

The other cause of tube leaks is thought to be tube thinning. Eddy current tests of the tubes have indicated that the thinning occurs on tubes near the tube sheet at levels corresponding to the levels of sludge that has accumulated on the tube sheet. The sludge is mainly iron oxide particulates and copper compounds along with traces of other minerals that have settled out of the feedwater onto the tube sheet, and into the annulus between the tube sheet and the tubes. The level of sludge accumulation may be inferred by eddy current testing with a low frequency signal that is sensitive to the magnetite in the sludge. The correlation between sludge levels and the tube wall thinning location strongly suggests that the sludge deposits provide a site for concentration of phosphate solution or other corrosive agents at the tube wall that results in tube thinning.

Additionally, each of the U-shaped heat exchanger tubes has a "hot leg" U-bend at its top and both "hot and cold legs" at the bottom end of each heat exchanger. Usually the bottom hot and cold legs are sludge treated/suctioned separately.

A number of patents have previously described moveable, high pressure, single head, sludge lance-suction methods of removing top tube sheet sludge including, for example, the patents previously set out, as well as U.S. Pat. Nos. 4,276,856; 4,572,284; 4,676,201; 4,774,975; 4,971,140; 5,036,871; 5,069,172; 5,615,734; 5,813,370; 6,513,462; and 7,967,918 (Dent et al.; Katscher et al.; Lahoda et al.; Ayres et al.; Stoss; Ruggieri et al.; Shirey et al.; Hyp; Owen et al.; Shiraishi et al.; and Collin et al., respectively). These sludge removal methods are utilized after an initial chemical cleaning which reduces the hard (tenaciously adhering) sludge on the tube sheet, especially in a "kidney" shaped high accumulation region in the hot leg zone, to a generally particulate film.

In most nuclear steam generators in service today, there are usually 6 inch (15.2 cm.) diameter hand holes in the shell of the steam generator near and above the tube sheet that has an associated hole in the wrapper providing access to the tube sheet for removal of the sludge deposits on the tube sheet.

In all the above apparatus, the single head used must stop at a central rod in the tube sheet, so that the central row of tubes across the tube lane and the hot and cold leg is difficult to clean, and that central row of tubes also crosses the middle of the "kidney" region of the hot leg. It is essential to remove sludge from 100% of the tubes and tube sheet surface. Leaving 5% or 10% of the sludge removal in a marginal state jeopardizes the entire sludge removal process, since it only takes a single leaking tube for potential contamination by radioactive particles from the primary fluid which is under high pressure and at about 650° C. Thus, there is a need for a method that can clean that central row effectively, and a main object of this invention is to provide such a method and apparatus.

SUMMARY OF THE INVENTION

The above mentioned problems are solved and object accomplished by providing a sludge lance for the secondary side of a tube bundle in a tubular steam generator having a plurality of entry handholes allowing access to a center tube lane, the bundle having a hot leg side and a cold leg side separated by the center tube lane which lane at its midpoint has a central stay rod, where the lance has dual lance heads. This is used by a method comprising the steps of:

1) opening at least one handhole; 2) introducing a moveable sludge lance having dual lance heads separated by a distance greater than the diameter of the central stay rod; and 3) sludge lancing the hot leg side and the cold leg side of the tube bundle with the moveable sludge lance, so that the dual lance heads traverse the central tube lane to extend beyond the central stay rod allowing continuous and complete lancing of the hot and cold sides of the tube bundle.

The invention primarily resides in a moveable sludge lance for use in lancing a tube bundle in a tubular steam generator by travel in a center tube lane to a midpoint center stay rod; said sludge lance comprising dual lance heads separated a distance greater than the diameter of the central stay rod used in the generator, wherein the dual lance heads can extend beyond the central stay rod, wherein the dual lance heads have a common frame and wherein a monorail provides a rigid platform for the dual lance heads, a rolling kickstand provides forward support for the monorail, and a jaw located forward of the kickstand can register the central stay rod with the forward position of the monorail.

BRIEF DESCRIPTION OF THE DRAWINGS

While the specification concludes with claims particularly pointing out and distinctly claiming the subject matter of the invention; it is believed the invention will be better understood from the following description, taken in conjunction with the accompanying drawings, wherein:

As used herein, the term "sludge lancing" or "sludge lance" means high pressure fluid cleaning through a plurality of nozzle jets on the sludge lance, which jets direct the fluid between the tubes in a steam generator and onto the tube sheet. The fluid is usually water and the jets align with tube row lanes formed by the spaces between rows of tubes. Also, as used herein, the term "dual heads" means a combination of at least cantilevered reaction bars, lance barrel assemblies and high pressure jet nozzles.

DESCRIPTION OF THE PREFERRED EMBODIMENTS

In a U-tube type steam generator, a tube sheet supports a bundle of heat transfer U-tubes. During operation, sludge forms on the tube sheet around the U-tubes and in the annulus between the U-tubes and the tube sheet, causing potential failure of the tubes. Failure of the tubes may result in a release of radioactive particles from the primary reactor coolant into the feedwater of the steam generator. The invention, herein described, is a method for removing this sludge accumulation before it causes tube failure.

Figure 1:
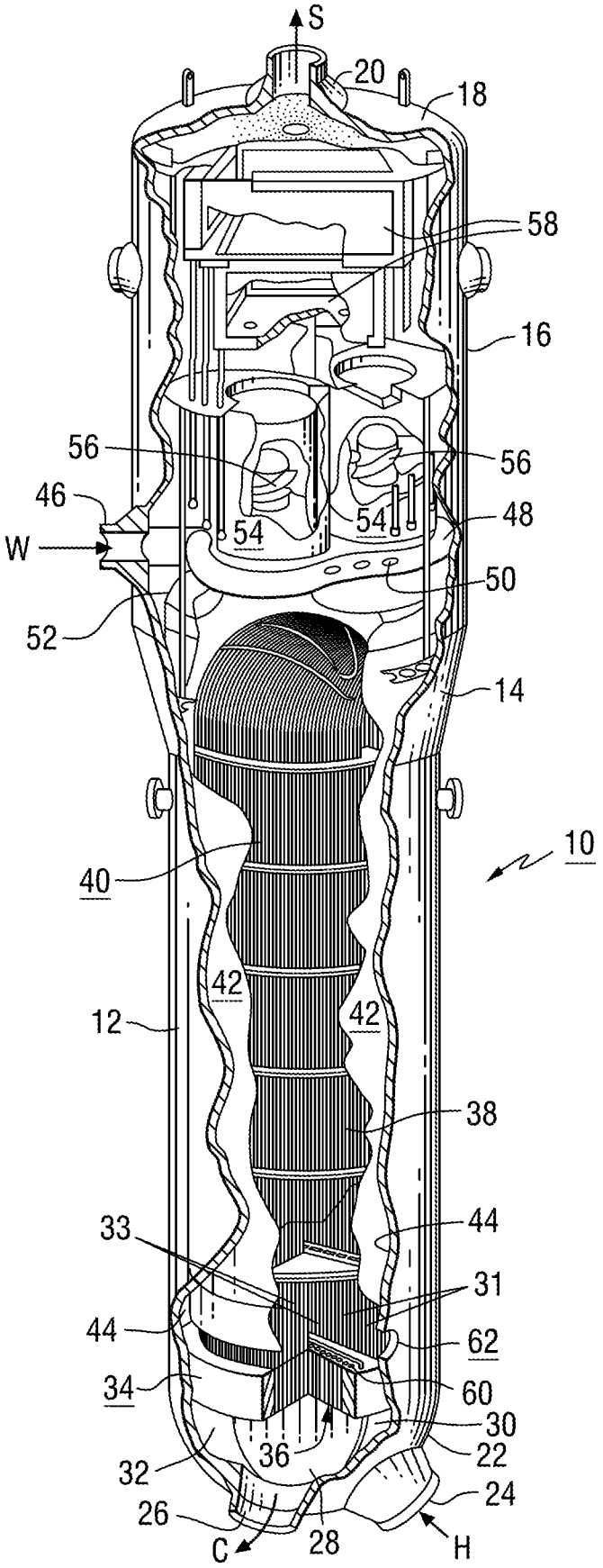
FIG. 1 PRIOR ART
FIG. 1 is a partial cross-sectional view in elevation of one example of a typical prior art steam generator.

Referring to FIG. 1, prior art nuclear steam generators includes a primary side 2 and a secondary side 4 among the tube bundle 40 (best shown in FIG. 3), hydraulically isolated from one another by a tube sheet 34. The nuclear steam generator referred to generally as 10, comprises a lower shell 12 connected to a frustoconical transition shell 14 which connects lower shell 12 to an upper shell 16. A dished head 18 having a steam nozzle 20 disposed thereon encloses upper shell 16 while a substantially spherical head 22 having inlet nozzle 24 and an outlet nozzle 26 disposed thereon encloses lower shell 12. A dividing plate 28 centrally disposed in substantially spherical head 22 divides the substantially spherical head 22 into an inlet compartment 30 and an outlet compartment 32.

The inlet compartment 30 is in fluid communication with inlet nozzle 24 while outlet compartment 32 is in fluid communication with outlet nozzle 26. A tube sheet 34, having tube holes 36 therein, is attached to lower shell 12 and substantially spherical head 22 so as to isolate the portion of steam generator 10 above tube sheet 34 from the portion below tube sheet 34 in a fluid tight manner.

Tubes 38, which are heat transfer tubes shaped with a U-like curvature, are disposed in tube holes 36. The tubes 38, which may number about 7,000, form a tube bundle 40. Dividing plate 28 is attached to tube sheet 34 so that inlet compartment 30 is physically divided from outlet compartment 32. Each tube 38 extends from tube sheet 34 where one end of each tube 38 is in fluid communication with inlet compartment 30, up into transition shell 14 where each tube 38 is formed in a U-like configuration, and back down to tube sheet 34 where the other end of each tube 38 passes through the tube sheet to be in fluid communication with outlet compartment 32.

In operation, hot reactor coolant fluid H having been heated from circulation through the reactor core enters steam generator 10 through inlet nozzle 24 and flows into inlet compartment 30. From inlet compartment 30, the reactor coolant fluid flows through tubes 38 in tube sheet 34, up through the U-shaped curvature of tubes 38, down through tubes 38 into outlet compartment 32. From outlet compartment 32, the now cooler (due to heat transfer) reactor coolant C is passed through outlet nozzle 26 and circulated through the remainder of the reactor coolant system. The inlet side of the tube bundle provides a tube hot leg 31 and tube return provides a tube cold leg 33 which exits to outlet compartment 32.

Again, referring to FIG. 1, tube bundle 40 is encircled by a wrapper 42 which extends from near the tube sheet 34 into the region of transition shell 14. Wrapper 42, together with lower shell 12, form an annular chamber 44. A secondary fluid or feedwater inlet nozzle 46 is disposed on upper shell 16 above tube bundle 40 inlets water W. A feedwater header 48 comprising three loops forming a generally cloverleaf-shaped ring is attached to feedwater inlet nozzle 46. Feedwater header 48 has therein a plurality of discharge ports 50 arranged in varying arrays so that a greater number of discharge ports 50 are directed toward annular chamber 44 than are directed otherwise.

During operation, inlet feedwater W enters steam generator 10 through feedwater inlet nozzle 46, flows through feedwater header 48, and out of feedwater header 48 through discharge ports 50. The greater portion of the feedwater exiting discharge ports 50, flow down annular chamber 44 until the feedwater contacts tube sheet 34. Once reaching the bottom of annular chamber 44 near tube sheet 34, the feedwater is directed inward around tubes 38 of tube bundle 40 where the feedwater passes in a heat transfer relationship with tubes 38. The hot reactor coolant fluid H being in tubes 38 transfers heat through tubes 38 to the feedwater thereby heating the feedwater. The heated feedwater then rises by natural circulation up through the tube bundle 40. In its travel around tube bundle 40, the feedwater continues to be heated until steam S is produced and passes through steam nozzle 20.

Now referring to the upper portion of FIG. 1, wrapper 42 has an upper cover or wrapper head 52 disposed thereon above tube bundle 40. Disposed on wrapper head 52 are sleeves 54 which are in fluid communication with the steam produced near tube bundle 40 and have centrifugal swirl vanes 56 disposed therein. Disposed above sleeves 54 is a moisture separator 58.

Referring now to the lower portion of FIG. 1, due to the curvature of tubes 38, a straight line section of tube sheet 34 is without tubes therein. This straight line section is referred to as central tube lane 60. In conjunction with central tube lane 60, two handholes 62 and 63 (only 62 shown in FIG. 1) are provided, diametrically opposite each other and in collinear alignment with the tube lane 60. Handholes 62 are six inch to eight inch (15.2 cm to 20.3 cm) diameter ports that allow limited access to the tube sheet 34 area.

Experience has shown that during steam generator operation sludge may form on tube sheet 34 around tubes 38 from the feedwater W. This sludge which usually comprises iron oxides, copper compounds, and other metals is formed from these materials settling out of the feedwater onto tube sheet 34. The sludge can produce defects over time in the tubes 38, which can allow radioactive particles in the reactor coolant contained in tubes 38 to leak out into the feedwater and steam S of the steam generator.

Figure 2:
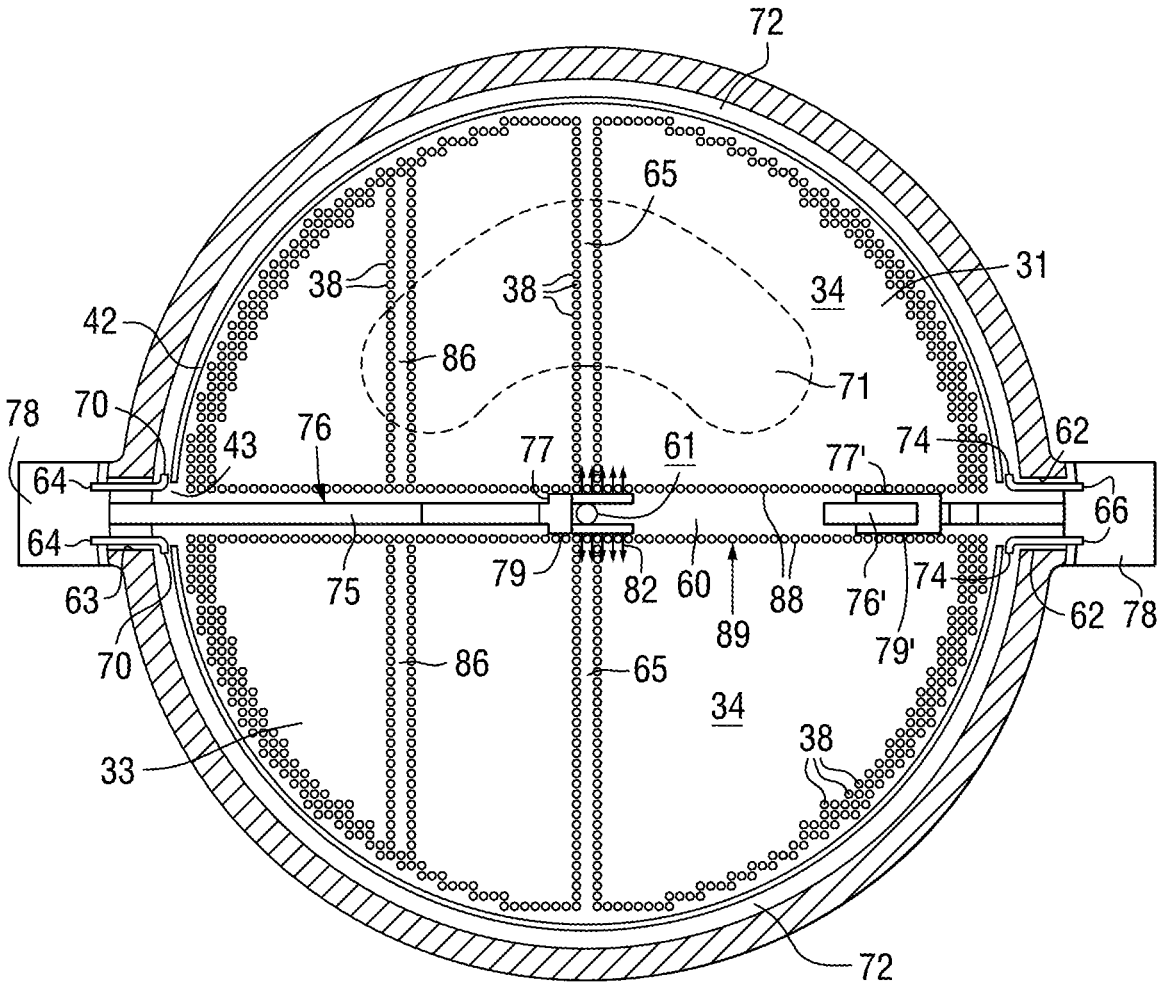
FIG. 2 is a plan view of the tube sheet and tubes in a steam generator showing the dual head sludge lance past the center stay rod.

Referring now to FIG. 2, when the reactor is not operating, such as during refueling, the steam generator may be deactivated and drained of the feedwater. Both handholes 62 and 63 can then be opened to provide access to the interior of the steam generator. An injection header 64 can be placed through one of the handholes 63 while a suction header 66 can be placed through the other handhole 62. The injection header 64 and the suction header 66 are shaped to fit through the handholes 62 and 63 while being able to fit around any obstructions which might block the central tube lane 60 which may be present near the handholes 62 and 63.

The injection header 64 is formed so that the two outlets 70 come to rest near the level of sludge accumulation on tube sheet 34. In addition, the outlets 70 which may be 9/16 inch (1.4 cm) nozzles face opposite each other in the direction of annulus peripheral lane 72 which is formed around the tube bundle 40. Likewise, the inlets 74 of suction header 66 face opposite each other while facing annulus peripheral lane 72. Injection header 64 is connected to a fluid supply such as a water supply and suction header 66 is connected to a suction pump (not shown) such as an air diaphragm suction pump.

Figure 3:
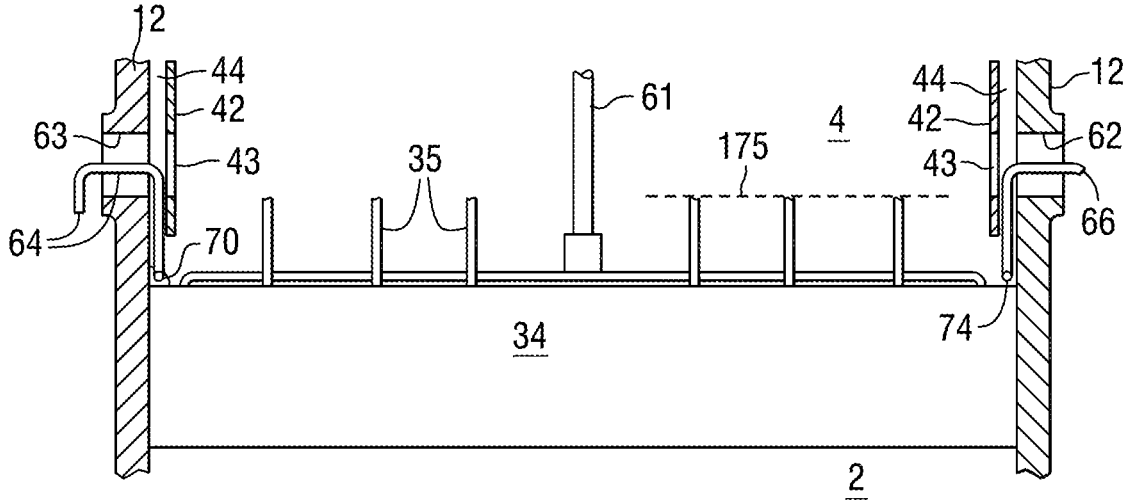
FIG. 3 PRIOR ART
FIG. 3 is a cross-sectional view in elevation of a typical steam generator near the tube sheet, showing the central stay rod in the center tube lane of the tube sheet.

Then, according to this invention, a moveable high pressure, sludge lance 76 having dual heads 77 and 79 is inserted into at least one of the handholes 62 and 63, through an opening in the wrapper 43 where it proceeds down one section of the central tube lane 60, down between row 1 tubes 88 to clean between adjacent tube gaps 89 which are very small, as generally shown in FIG. 2. As can be seen, the dual heads 77 and 79, having included lance assemblies fitted with high pressure nozzle jets/holes, connected to a cleaning fluid supply, to eject cleaning fluid 82 (shown as arrows), such as pressurized water, can extend beyond the end of integral support frame 75, such as monorail 208 shown in FIG. 5, to allow cleaning beyond and around the central stay rod 61 which helps support the tube sheet 34. This allows cleaning of all tube rows including the central cross row 65 of tubes, transverse to central tube lane 60 and centered on the central stay rod 61, as will be described in detail later. Advantageously, a second moveable, high pressure sludge lance 76' having dual heads 77' and 79' also fitted with nozzle jets/holes, connected to a cleaning fluid supply, is also shown moving down another section of the central tube lane 60 simultaneously. It will also stop at the central stay rod 61 generally shown in FIG. 3. Preferably, both moveable, high pressure sludge lances are operated simultaneously sludge lancing both the tube hot leg 31 and the tube cold leg 33. Returning to FIG. 2, also shown is the central cross row 65 of tubes across the tube lane 60, the tube hot leg 31 and tube cold lea 33 of the tube bundle, and the "kidney" shaped high sludge accumulation region 71 (shown by dashed lines) where most hard sludge develops. Other tube lanes are shown as 86 and individual tubes as 38. The opening in the wrapper 42 is shown as 43. In FIG. 3, tube lane water block velocity structures 35 which slow down the velocity of water entering the central tube lane are shown bonded to the tube sheet 34.

Figure 5:
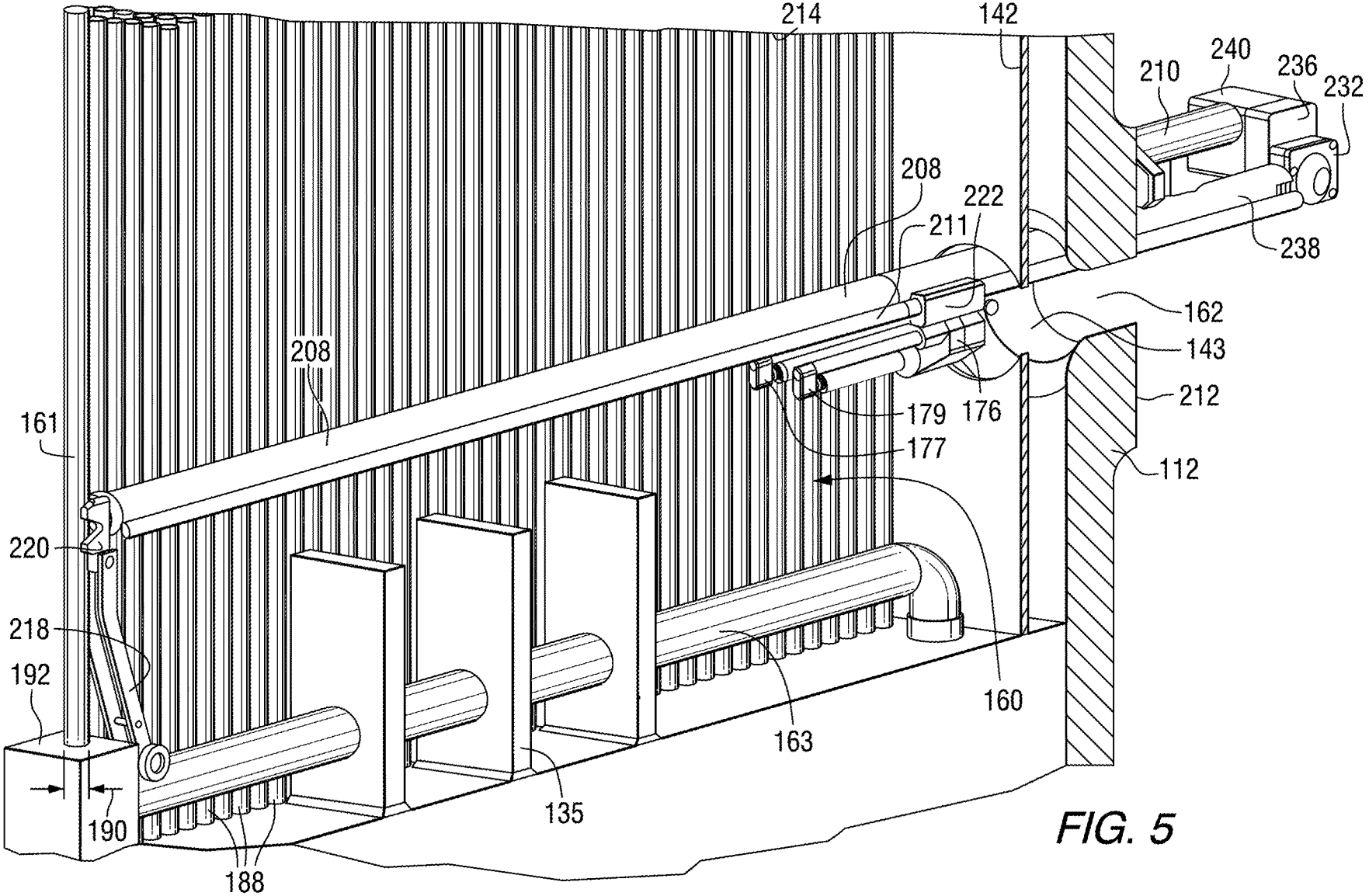
FIG. 5, which best shows the invention, is a partial-sectioned three dimensional view of the entire dual head sludge lance apparatus of this invention, inserted into a hand hole in the lower shell of the steam generator and able to traverse the central tube lane over various support structures, to the central stay rod of the tube sheet support, where the dual head of the sludge lance can bypass and extend beyond the central stay rod.

The sludge lance of this invention, comprises a mounting mechanism 78 which is capable of being bolted to the area surrounding handhole 62 or 63. Once the lance is in place, the water supply to injection header 64 is activated while the suction pump associated with suction header 66 is activated. The flow of water from outlets 70 causes a peripheral stream of water to be established from outlets 70, through annulus peripheral lane 72 into inlets 74 of suction header 66. As shown in FIG. 5, the sludge lance of this invention is capable of passing over obstructions such as tube lane blocks to reach the endpoint at the central stay rod 161. For example, a dual head insertion device such as a flat thin support can be laid on the top of the tube lane block 135 along plane 175, shown in FIG. 3, to allow ease of travel to the endpoint.

Figure 4:
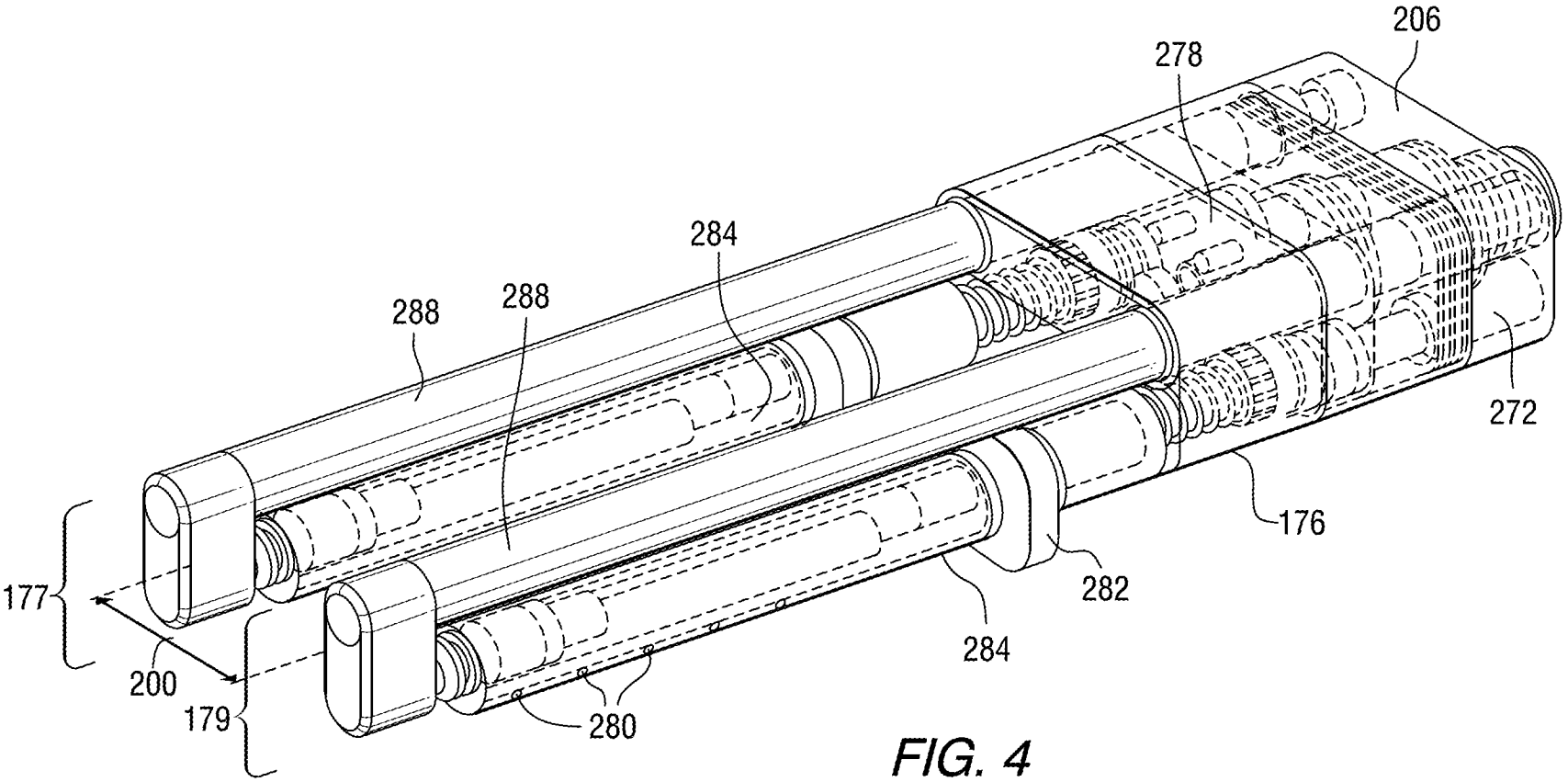
FIG. 4 is a partial-sectioned three dimensional view of the sludge lance of this invention, having dual heads for cleaning.

Referring specifically now to FIGS. 4 and 5, one moveable, high pressure sludge lance 176 is shown with dual heads 177 and 179, with included lance barrel assemblies 284 having a plurality, usually four to six high pressure jet nozzles 280 connected to a cleaning fluid supply, to eject cleaning fluid such as pressurized water. The dual heads 177 and 179 and lance barrel assemblies are spaced apart by a distance 200 which is large enough to bypass central stay rod 161 but not hit or scrape row 1 tubes 188. As used herein, the term "dual heads" 177 and 179 means cantilevered reaction bars 288, lance barrel assemblies 284 and high pressure jet nozzles 280. Gaps between the tubes are best shown in FIG. 2 as 89. The distance 200 is generally between 1.70 inches and 1.75 inches (4.32 cm and 4.44 cm). Also shown in FIG. 5 are the lower shell 112, wrapper 142, opening in the wrapper 143, hand hole 162, blow down tube 163, tube lane blocks 135, central tube lane 160 and diameter 190 of the central stay rod inserted into a stay rod support block 192.

The sludge lance system of this invention can reduce lancing time by 50%. This is accomplished by the preferred simultaneous lancing of the hot and cold leg side of a steam generator secondary side tube sheet. In FIG. 5, a reciprocating mechanism driven by a flexible shaft produces oscillation motion of two dual heads 177 and 179 containing parallel and independent cantilevered reaction bars 288 and lance barrels assemblies 284 containing high pressure nozzles 280, which can be single holes. These are supported by a common support frame 206. The common support frame 206 is supported by a monorail 208 that is suspended in the central tube lane 160, that is, supported by the center stay rod 161, and a monorail hanger 210 attached to the handhole pad face 212. The independent dual heads have sufficient axial compliance combined with a tube gap locating knuckle to automatically align with any adjacent misdrilled Row 1 tubes 188.

The sludge lance system of this invention is comprised of six major components:

1) A monorail 208 which provides a rigid platform for precise location of the Row 1 tubes 188 and tube gaps 214. It is assembled in three pieces with interconnecting sockets and register pins to hold the rail sections together while it is inserted in the central tube lane. A rolling kickstand 218 provides forward support of the monorail 208, during insertion and assembly in the steam generator tube central lane 160. A jaw 220 located forward of the rolling kickstand 218 registers on the center stay rod 161 to center the forward end of the monorail. The jaw engages a duplicate monorail assembly (shown in FIG. 2) which can be installed simultaneously in the opposing tube lane handhole. There are no exposed fasteners between the rail assemblies that could become foreign objects in the bundle.

2) A carriage 222, mounted on the monorail and having the dual heads 177 and 179 attached traverses the monorail 208, and is machined from aluminum alloy billet with a series of upper and lower roller sleeves and bearings (not shown for sake of simplicity) providing a low friction connection between it and the monorail rails 211. Locomotion of the carriage is accomplished by a continuous timing belt (not shown) running between the index gearbox assembly 232 and a tensioning system (in the form of a gas spring and bearing supported cog wheel—not shown as interior to the monorail) located in the forward end of the monorail.

3) A gearbox assembly 236 provides either incremental or continuous translation of the carriage from one end of the monorail to the other. The socket end of the gearbox 238, which locates the continuous timing belt both axially and parallel to the monorail, contains a screw-driven wedge assembly 240 that extends forward as the screw is rotated clockwise, and applies a compressive force on a series of pushrods that terminates at the aft end of a gas spring which is supported by the forward cog wheel and cross-axle translating in a horizontal slot in the forward end of the monorail. Since the length of the timing belt is fixed between the cog wheels, the applied compressive force of the screw-drive wedge assembly against the cog wheels, the applied compressive force of the screw-drive wedge assembly against the pushrods forces the timing belt to the prescribed operating tension.

4) A monorail 208 is supported at the handhole end of the tube lane by a specifically designed monorail hanger 210 and lug that is positioned on and attached to the upper threaded holes (used for cover closure) in the handhole pad face 212. The hanger 210 contains a threaded shaft and torque limiter that is rotated clockwise to position a lug over a clevis on the monorail 208; the monorail 208 is raised into the lug and pinned through the clevis to support the monorail 208 horizontally in the central tube lane 160. The hanger 210 has sufficient lateral movement to accommodate a 0.6 degree radial shift in the position of the handhole relative the central tube lane centerline. Once positioned along the centerline of the central tube lane, the monorail is forced in compression against the central stay rod 161 by the clockwise rotation a torque limiter which unloads at the force required to secure the monorail in the tube lane against the jaw 220 of the opposing monorail (not shown).

5) An automated take-up reel which is positioned on the handhole pad face 212 to provide end effector cable and hose management. The take-up reel houses a flexible shaft drive not shown which provides oscillation motion to a lance end effector thus eliminating any electro-motive interference that may be generated by a stepper motor in close proximity to the Row 1 tubes 188—this allows sludge lancing to be accomplished simultaneous with Eddy Current testing of the tube bundle. A pair of ⅜" (0.95 cm) high pressure hoses are attached to the central axle of a take-up reel to provide high pressure flow to the lance head.

The moveable, high pressure sludge lance 176 is attached to the bottom side of the carriage by means of a set of four button head fasteners that engage keyhole type slots in the carriage; a lance end effector is further latched to prevent dislocation of the end effector from the carriage in the tube lane. The sludge lance end effector incorporates a mechanical oscillation mechanism 278 driven by the flexible shaft drive which permits simultaneous lancing of both hot and cold legs of the steam generator tube sheet by cleaning fluid input through high pressure hoses 272. The lance barrel assemblies 284 have ½ inch (1.27 mm) of axial compliance allowing precise and independent alignment of a high pressure jet nozzles 280 within the adjacent tube gaps. The alignment is accomplished during the oscillation cycle of the lance barrels; a thermoplastic knuckle 282 located one (1) tube pitch aft of the first high pressure jet is rotated in the gap generated by the pitch (or spacing) of the Row 1 tubes 188. The thermoplastic knuckle 282 is designed similar to a wedge with a slightly smaller cross-section than the geometry generated by the Row 1 tube diameter and pitch. If the tube alignment becomes asymmetrical on the secondary side of the tube sheet, the knuckle is forced laterally during the oscillation (rotation) sequence and further rotated into the tube thus aligning the high pressure jets within the adjacent tube gaps.

The lance barrel assembly 284 does not incorporate commercially available removable jets due to the potential for loose parts in the steam generator. Sludge lancing/jetting is accomplished by drilling jet nozzles 280 or jet holes of a specific diameter in the lance barrel assembly 284 to yield the correct system parameters. The high pressure jets nozzles 280 maintain a 6:1 length to diameter ratio which is sufficient for collimation of the high pressure jet in the tube gap. The lance barrel assemblies are supported on either end axially by a set of needle roller bearings and further supported horizontally by a set of cantilevered reaction bars which resist the thrust force of the lance under full system pressure, thus allowing the dual head 177 and 179 bodies to act independently of each other. The reaction bars are set parallel to each other and separated by a distance 200 slightly greater than the diameter of the central stay rod 161, thus allowing the lance barrel assemblies 284 to index past the central stay rod 161 and perform central stay rod region lancing, for example, in the central cross row of tubes 65 (as shown in FIG. 3).

While there is described what is now considered to be the preferred embodiment of the invention, it is, of course, understood that various other modifications and variations will occur to those skilled in the art. The claims, therefore, are intended to include all such modifications and variations which fall within the true spirit and scope of the present invention.

What is claimed is:

1. A moveable sludge lance system having a sludge lance for use in cleaning a tube bundle in a tubular steam generator by travel in an elongated center tube lane having a midpoint center stay rod in the center of the center tube lane and, wherein the center tube lane defines a longitudinal axis, said sludge lance comprising:

a support carriage moveable along the longitudinal axis of the center tube lane from a peripheral end of the tube bundle to a fully extended position adjacent the midpoint center stay rod; and dual lance heads extending from the support carriage, wherein the dual lance heads are connected to one another by the support carriage such that the dual lance heads move together along the longitudinal axis, wherein the dual lance heads are parallel to each other and to the longitudinal axis, wherein an open space is defined between the dual lance heads, wherein the open space has a width transverse to the longitudinal axis a distance greater than a diameter of the midpoint center stay rod, and wherein the dual lance heads are configured to extend on either side of the midpoint center stay rod when the support carriage reaches the fully extended position.

2. The moveable sludge lance system of claim 1, wherein a monorail on which the support carriage rides provides a platform for the dual lance heads, wherein the monorail comprises a jaw supported on a forward portion of the monorail, and wherein the jaw attaches the midpoint center stay rod with the forward portion of the monorail.

3. The moveable sludge lance system of claim 1, wherein the sludge lance is fitted with nozzle jets on the dual lance heads that are configured to spray on either side of the center tube lane without interference of the midpoint center stay rod at a location of the midpoint center stay rod.

4. The moveable sludge lance system of claim 1, wherein the tubular steam generator has a plurality of entry handholes allowing access to the center tube lane, the tube bundle having a hot leg side and a cold leg side separated by the center tube lane, the moveable sludge lance system being at least partially supported outside the steam generator and extending through at least one of the handholes into the center tube lane to the midpoint center stay rod, wherein the dual lance heads are configured to traverse the center tube lane to extend on either lateral side of the midpoint central stay rod, and wherein a cleaning fluid passes through the dual lance heads as the support carriage traverses the center tube lane to extend on either lateral side of the midpoint central stay rod.

5. The moveable sludge lance system of claim 4, wherein a gearbox assembly moves the support carriage along a monorail, wherein the dual lance heads comprise cantilevered reaction bars and lance barrel assemblies, wherein the lance barrel assemblies comprise jet nozzles, wherein the reaction bars and lance barrel assemblies extend from a common frame of the support carriage, and wherein the reaction bars and lance barrel assemblies are parallel to the longitudinal axis of the center tube lane.

6. The moveable sludge lance system of claim 5, wherein the support carriage traverses the longitudinal axis of the center tube lane by means of monorail rails supported parallel to the monorail, wherein the movable sludge lance system further comprises a jaw means located forward of the monorail, and wherein the jaw means attaches the midpoint center stay rod to the monorail.

7. The moveable sludge lance system of claim 6, wherein the jaw means is configured to engage a second monorail extending along the center tube lane from a second handhole substantially opposite the at least one of the handholes, the second monorail configured to moveably support a second support carriage and lance head that is configured to move along the second monorail.

8. The moveable sludge lance system of claim 7, wherein the second support carriage and lance head are configured to operate substantially simultaneously with the sludge lance.

9. The moveable sludge lance system of claim 4, wherein the dual lance heads are respectively configured to clean both the hot leg side and the cold leg side of the tube bundle simultaneously.

10. The moveable sludge lance system of claim 4, wherein a portion of each dual lance head operates in an oscillation motion.

11. The moveable sludge lance system of claim 1, wherein the dual lance heads are connected to one another by a common support frame of the support carriage.

12. The moveable sludge lance system of claim 1, wherein the dual lance heads comprise a first lance head and a second lance head fixed relative to one another by the support carriage, wherein the first lance head comprises a first barrel assembly comprising first jet nozzles, wherein the second lance head comprises a second barrel assembly comprising second jet nozzles, and wherein the first barrel assembly and the second barrel assembly are configured to oscillate relative to the support carriage.

* * * * *